United States Patent [19]

Kuypers

[11] Patent Number: 4,745,716

[45] Date of Patent: May 24, 1988

[54] STRUCTURAL WATER CONTROL

[76] Inventor: Fred A. Kuypers, 17148 Odell, Tinley Park, Ill. 60477

[21] Appl. No.: 897,057

[22] Filed: Aug. 15, 1986

[51] Int. Cl.[4] ..... E04B 1/70; E04F 17/00

[52] U.S. Cl. ..... 52/169.5; 52/169.14; 52/302; 405/43; 405/45

[58] Field of Search ..... 405/43, 45, 48, 36; 52/109.5, 169.14, 310, 302, 303, 221, 98, 62

[56] References Cited

U.S. PATENT DOCUMENTS

| | | | |
|---|---|---|---|
| 3,283,460 | 11/1966 | Patrick | 52/169.5 X |
| 3,852,925 | 12/1974 | Gazzo | 52/169.5 |
| 4,045,964 | 9/1977 | Barclay | 52/169.5 X |
| 4,245,443 | 1/1981 | Beechen | 52/169.5 |
| 4,381,630 | 5/1983 | Koester | 52/169.5 |

*Primary Examiner*—Dennis L. Taylor

*Attorney, Agent, or Firm*—John Vander Weit, Jr.

[57] ABSTRACT

A product useful for preventing water seepage onto a floor in a structure having a foundation, a footing, a floor and a drain below the floor, including a barrier having a cross-sectional shape which forms conduit portions and contact portions, the barrier being suitable for placement against the foundation and the footing prior to installation of the floor, the barrier having an upper diverter suitable for placement against the foundation, the barrier having a lower diverter suitable for placement against the footing, the upper diverter being connected to the lower diverter at approximately right angles to one another, the lower diverter extending a distance away from the foundation farther than the footing extends from the foundation, the cross-sectional shape providing conduit portions which allow water to travel through the upper diverter conduit portions to and through the lower diverter conduit portions to a point under the floor and away from the footing to the drain under the floor and the cross-sectional shape providing contact portions which allow substantial structural contact between the floor and the foundation, and the floor and the footing.

24 Claims, 3 Drawing Sheets

STRUCTURAL WATER CONTROL

BACKGROUND OF THE INVENTION

This invention relates generally to the control of water in structures and more particularily concerns a product useful for preventing water seepage onto a floor in a structure having a foundation, a footing and a floor. One of the most troublesome problems in homebuilding is providing a basement that will avoid water seepage or other problems caused by water entering the basement of the home. Others have tried drains located in several locations, sump pumps and numerous types of exterior coatings or protective barriers to keep water from entering the basement of a structure. However, eventually the structure shrinks, cracks, moves or rearranges itself so that the prior methods prove ineffective or fail.

Accordingly, it is an object of this invention to provide a product which will allow for construction of a basement in a structure which will prevent water seepage onto a floor of the basement even when the structure is subject to cracks in the walls, seepage or other problems which occur upon aging of the structure.

Another object is to provide for the elimination of water seepage or leaking from the inner surface of a wall rather than the outer surface of a wall.

An allied object is to accomplish the removal of water without weakening the structure or substantially deteriorating the structural support of the home.

SUMMARY OF THE INVENTION

In accordance with the invention, a product useful for preventing water seepage onto a floor in a structure having a foundation, a footing, a floor and a drain below the floor is provided which, includes a barrier having a cross-sectional shape which forms conduit portions and contact portions, the barrier being suitable for placement against the foundation and the footing prior to installation of the floor, the barrier having an upper diverter suitable for placement against the foundation, the barrier having a lower diverter suitable for placement against the footing, the upper diverter being connected to the lower diverter at approximately right angles to one another, the lower diverter extending a distance away from the foundation farther than the footing extends from the foundation, the cross-sectional shape providing conduit portions which allow water to travel through the upper diverter conduit portions to and through the lower diverter conduit portions to a point under the floor and away from the footing to the drain under the floor and the cross-sectional shape providing contact portions which allow substantial structural contact between the floor and the foundation, and the floor and the footing.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included in the spirit and scope of this invention as defined in the appended claims.

DETAILED DESCRIPTION OF THE INVENTION

Figure 1:
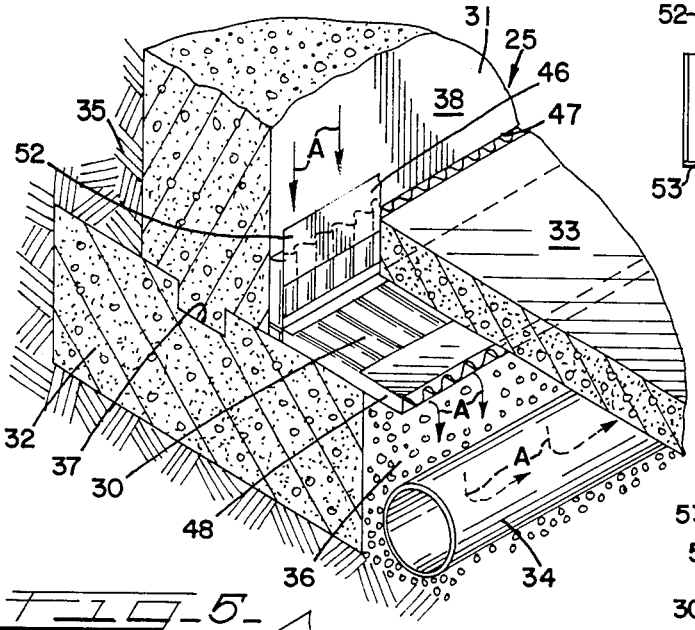
FIG. 1 is a sectional perspective view of a product of the instant invention installed in a structure.

Turning first to FIG. 1 there is shown a sectional perspective view of a structure 25 which embodies a product 30 constructed in accordance with the instant invention. Structure 25 includes a foundation 31, a footing 32, a floor 33 and a drain 34. Structure 25 is enclosed by earth 35 and fill 36.

In construction of structure 25, earth 35 was first excavated and footing 32 was installed by conventional means; for example, poured concrete. Footing 32 includes a notch 37 which is useful for aligning foundation 31 and supporting it from side forces. After footing 32 has been installed, foundation 31 is installed by conventional means; for example it may be poured concrete. Foundation 31 has a vertical wall 38 on its interior surface. Drain 34 is then installed and may be conventionally made from drain tile made of clay, plastic or other material. The drain tile may be porous or have openings which allow water to enter it. Drain 34 will provide a conduit for water or other fluid and will convey it to a lower point of an exterior drainage area, or a sewer, or to a sump which may pump the water to the exterior drainage area outlet or sewers. Drain 34 is a conduit below floor level which will provide an outlet for any water which is present. After drain 34 is installed, fill 36 is installed to cover the drain and to avoid using large amounts of concrete when the floor is poured. Fill 36 allows easy passage of water through it to drain 34. The construction steps so far are conventional and have been used for many years.

According to the invention, a user now inserts product 30 against foundation 31 and footing 32. After product 30 has been inserted around substantially the entire exterior foundation and exterior footing of the structure, then a floor 33 is installed, for example by poured concrete. The pouring of concrete is done conventionally. Thus, in construction utilizing a product constructed in accordance with the instant invention, product 30 is placed alongside the exterior foundation and exterior footing prior to pouring of the concrete floor.

Figure 3:
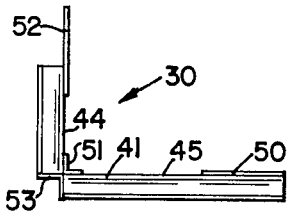
FIG. 3 is a side sectional view of the product of FIG. 1.
Figure 2:
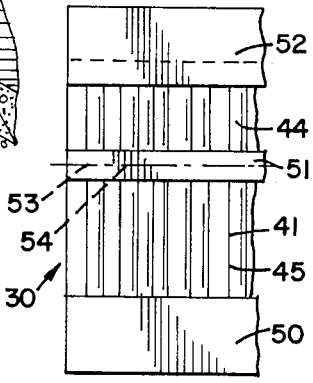
FIG. 2 is a top view of the product of FIG. 1 before installation in a structure.
Figure 4:
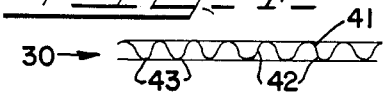
FIG. 4 is an end sectional view of the product of FIG. 2.

As is shown in FIGS. 2, 3 and 4, product 30 includes a barrier 41 having a cross-sectional shape which forms conduit portions 42 and contact portions 43. Barrier 41 has an upper diverter portion 44 which is suitable for placement against the foundation and a lower diverter portion 45 which is suitable for placement against the footing. As best seen in FIG. 1 and FIG. 3, said upper diverter 44 is connected to said lower diverter 45 at approximately right angles to one another. Upper diverter 44 may extend above the surface of floor 33 as shown in FIG. 1 at point 46 or it may be trimmed even or below the floor surface as shown at point 47. Lower diverter 45 must extend away from foundation 31 farther than footing 32 extends from foundation 31. Thus, portion 48 of lower diverter 45 extends away from foundation 31 farther than footing 32. As seen in FIG. 4, barrier 41 has a cross-sectional shape which provides conduit portions 42 and contact portions 43. After installation, the upper diverter conduit portions and lower diverter conduit portions will allow water to flow from wall 38 through upper diverter conduit portions, through lower diverter conduit portions, through fill 36 to drain 34 as shown by arrows A. Equally as important, said contact portions will allow substantial structural contact between floor 33 and foundation 31 through upper diverter contact portions and substantial structural contact between floor 33 and footing 32 through lower diverter contact portions. Without substantial structural contact between the floor and the foundation wall, the walls could be forced in by earth 35. Even a slight movement could cause extensive cracking of the foundation. Likewise without substantial structural contact between the floor and the footing, the floor could shift slightly which would cause extensive cracking of the floor. By the term "substantial structural contact", it is meant that the contact between the floor and the foundation or footing is by portions of material that will not significantly crack or break over the life expectancy of the structure being built. If the floor is made of concrete, this means that the stone or aggregate of the concrete must firmly abutt against the contact portion of the product of the instant invention.

Product 30 as shown in FIGS. 1, 2, 3 and 4, is made from a corrugated board strong enough so as to keep its rigidity during the time after floor 33 is poured until it sets. When floor 33 is made with concrete the corrugated board must retain said rigidity long enough to allow the concrete of floor 33 to set, that time being about twenty-four hours. Thus, the corrugated board must be made of material that will resist or have a resistance to the water or the concrete for a period of time which will allow the concrete to set. This may be achieved by coating barrier 41 with a waterproof coating which will provide the desired rigidity. Protective strip 50 strengthens the corrugated board during installation so as to provide insignificant deformation should an installer walk on barrier 41. Connecting strip 51 provides for connection of upper diverter 44 and lower diverter 45. Alignment strip 52 allows a user to level the floor by using a string and chalk or other conventional means to mark the desired level on alignment strip 52 so that the concrete can be poured to the desired level. The floor may be poured to a level that is either above or below upper diverter 44 as long as the concrete does not flow over alignment strip 52. Installation strip 53 is provided so that during installation, concrete from floor 33 will not block the communication between upper diverter conduit portions and lower diverter conduit portions. Installation strip 53 must degrade over a period of time to allow continuous conduit of water from wall 38 through upper diverter 44 to the lower diverter 45.

In construction of product 30, a one sided corrugated board may be utilized as barrier 41 which then has protective strip 50, connecting strip 51 and alignment strip 52 fastened to the side of the corrugated board without a facing. Then, the facing and flutes of barrier 41 of the one sided corrugated board is cut opposite connecting strip 51. This slit 54 is shown in FIG. 2. Then the corrugated board is then folded along slit 54 and installation strip 53 is fastened along the broken flutes of the corrugated board as can be seen in FIG. 3. Of course, installation strip 53 must resist the water and concrete for a time sufficient to allow the concrete to set, before it degrades.

The material used to produce product 30 may eventually biodegrade, however, once the concrete has set, the significant structural contact has been provided so that the actual presence of product 30 is unnecessary. It is of critial importance that contact portions of the barrier significantly support the floor and the wall, because without significant support the walls, floors, foundation or footing may move, slide or be displaced. A displacement of a fraction of an inch could cause severe cracking of the walls, floor, foundation or footing. As seen in FIG. 1, alignment strip 52 may either extend above the floor surface or be cut off even with or below the floor surface. In ether case, the user of the structure must avoid filling the conduit portions of the barrier with debris. This will not be a problem if the interior foundation wall 38 is dry walled or otherwise finished allowing enough space to keep the upper conduit openings of upper diverter 44 unblocked.

Figure 5:
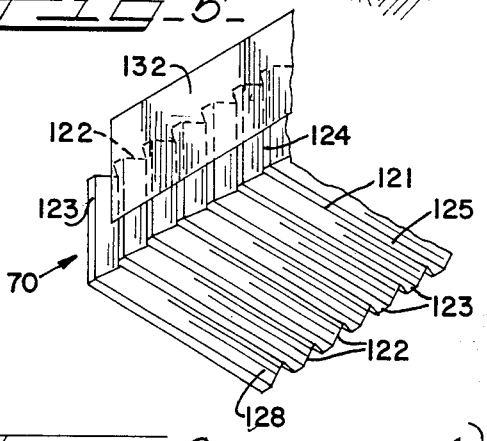
FIG. 5 is another embodiment of a product constructed in accordance with the principles of the instant invention.
Figure 7:
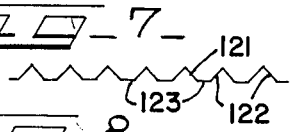
FIG. 7 is an end sectional view of the product shown in FIG. 5.

Turning to FIG. 5 and FIG. 7, there is shown product 70 constructed with the principles of the instant invention. A user can insert product 70 against a foundation and a footing similar to that of product 30. After product 70 has been installed around substantially the entire exterior foundation and exterior footing of the structure, then a floor of poured concrete is installed. The pouring of concrete is done conventionally.

As is shown in FIGS. 5 and 7, product 70 includes a barrier 121 which has a predetermined cross-sectional shape which forms conduit portions 122 and contact portions 123. Barrier 121 has an upper diverter portion 124 which is suitable for placement against the foundation and a lower diverter portion 125 which is suitable for placement against the footing. As best seen in FIG.

5, said upper diverter 124 is connected to said lower diverter 125 at approximately right angles to one another. Upper diverter 124 may extend above the surface of a floor or it may be trimmed even or below the floor surface. Lower diverter 125 must extend away from a foundation farther than a footing extends from the foundation. Thus, portion 128 of lower diverter 125 extends away from the foundation farther than the footing. As seen best in FIG. 7, barrier 121 has a cross-sectional shape which provides conduit portions 122 and contact portions 123. After installation, the upper diverter conduit portions and lower diverter conduit portions will allow water to flow from a wall through upper diverter conduit portions, through lower diverter conduit portions, to a drain. Equally as important, said contact portions 123 will allow substantial structural contact between the floor and foundation through upper diverter contact portions and substantial structural contact between the floor and footing through lower diverter contact portions. Without substantial structural contact between the floor and the foundation wall, the walls could be forced in.

Product 70 may be made from a plastic or other material strong enough so as to keep its rigidity during the time after floor is poured until it sets. The plastic material should resist or have a resistance to the water or the concrete for a period of time which will allow the concrete to set. The plastic or other material should also be strong enough to provide insignificant deformation should an installer walk on barrier 121. Alignment portion 132 allows a user to level the floor by using a string and chalk or other conventional means to mark the desired level on alignment strip 132 so that the concrete can be poured to the desired level. The floor may be poured to a level that is either above or below upper diverter 124 as long as the concrete does not flow over alignment strip 132.

Figure 6:
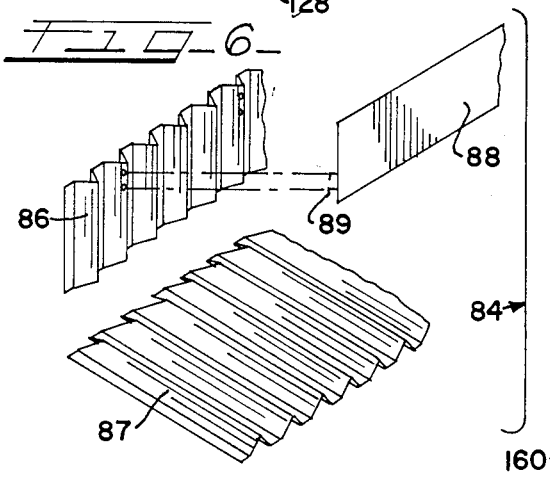
FIG. 6 is still another embodiment of a product constructed in accordance with the principles of the instant invention.

Product 70 may be made in one piece as shown or may be made in several pieces as seen in FIG. 6. There, product 84 comprises separate pieces. Upper diverter 86, lower diverter 87 and alignment strip 88 can be attached to each other to form a product substantially the same as product 70. Attachment means 89 on alignment strip 88 can join alignment strip 88 to upper diverter 86. Upper diverter 86 can be set in place upon lower diverter 87. One advantage to this separation of product 70 into several pieces is that it allows the product to take less space during shipment. Similarily, the product can be made in two pieces by having the upper diverter and lower diverter made in one piece and having the separate alignment strip attachable to the diverter piece.

Figure 9:
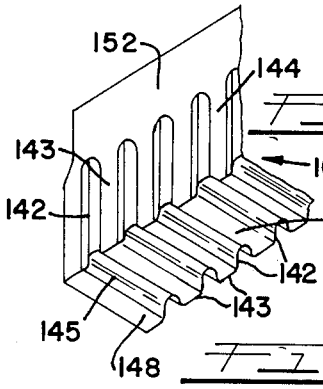
FIG. 9 is still another embodiment of a product constructed in accordance with the principles of the instant invention.
Figure 10:
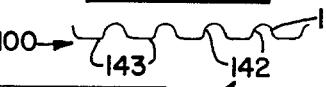
FIG. 10 is an end sectional view of the product shown in FIG. 9.

Turning to FIG. 9 and FIG. 10, there is shown product 100 constructed in accordance with the principles of the instant invention. A user can insert product 100 against a foundation and a footing similar to that of product 30. After product 100 has been inserted around substantially the entire exterior foundation and exterior footing of the structure, then a floor of poured concrete is installed. The pouring of concrete is done conventionally.

As is shown in FIGS. 9 and 10, product 100 includes a barrier 141 which has a cross-sectional shape which forms conduit portions 142 and contact portions 143. Barrier 141 has an upper diverter portion 144 which is suitable for placement against the foundation and a lower diverter portion 145 which is suitable for placement against the footing. As best seen in FIG. 9, said upper diverter 144 is connected to said lower diverter 145 at approximately right angles to one another. Upper diverter 144 may extend above the surface of a floor or it may be trimmed even or below the floor surface. Lower diverter 145 must extend away from a foundation farther than a footing extends from a foundation. Thus, portion 148 of lower diverter 145 extends away from a foundation farther than the footing. As seen best in FIG. 10, barrier 141 has a cross-sectional shape which provides conduit portions 142 and contact portions 143. After installation, the upper diverter conduit portions and lower diverter conduit portions will allow water to flow from a wall through upper diverter conduit portions, through lower diverter conduit portions, to a drain. Equally as important, said contact portions 143 will allow substantial structural contact between the floor and the foundation through upper diverter contact portions and substantial structural contact between the floor and the footing through lower diverter contact portions. Without substantial structural contact between the floor and the foundation wall, the walls could be forced in.

Product 100 may be made from a plastic or other material strong enough so as to keep its rigidity during the time after floor is poured until is sets. The plastic or other materal should resist or have a resistance to the water or the concrete for a period of time which will allow the concrete to set. The plastic or other material should also be strong enough to provide insignificant deformation should an installer walk on barrier 141. Alignment strip 152 allows a user to level the floor by using a string and chalk or other conventional means to mark the desired level on alignment strip 152 so that the concrete can be poured to the desired level. The floor may be poured to a level that is either above or below upper diverter 144 as long as the concrete does not flow over alignment strip 152. Alignment strip 152 is formed so as to close the top openings of the conduit portions of said upper diverter to avoid having concrete flow into the conduits. However, alignment strip 152 must still keep the concrete above the upper diverter from contacting the wall of the foundation. Preferably, the alignment strip keeps the concrete at least one-quarter inch from the foundation wall.

Figure 8:
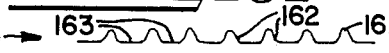
FIG. 8 is an end sectional view of still another embodiment of a product constructed in accordance with the principles of the instant invention.

FIG. 8 shows a cross-sectional end view of product 160 which has barrier 161 with conduit portions 162 and contact portions 163. Product 160 in other respects is similar to product 100. A variety of cross-sectional shapes can accomplish the results of the instant invention. Thus, the cross-sectional of a barrier can be corrugated as in FIG. 4, a series of chevrons having the contact portions flattened as in FIG. 7, a serpentine curve having flattened contact portions wider than conduit portions as in FIG. 8, or with conduit portions having a substantially circular area with flattened contact portions as in FIG. 10. The circular radius can vary from three-quarters inch to three inches.

The conduit portion in all varieties is designed to allow for the estimated water flow rate. Thus, if the open area of a conduit is small, then more conduits would be needed. Conversely, if the conduit flow area is large, less conduits are needed. Thus, the conduit portion of the barrier would extend away from the point of contact of the contact portion of the barrier from the foundation or footing by a distance of approximately one-quarter inch to one and one half inch, but preferably by not greater than three-quarters inch.

The contact portion in all varieties of the barrier is desired to be substantially flat. This will provide maximum contact area between the floor and the foundation or footing. The contact portion should be at least one-quarter inch and more preferably at least one inch or greater. The larger the contact portion the more stable the structure. When using concrete with a given stone or aggregate diameter, the contact portion should preferably be wider than the diameter of the stone. The width must at least allow the stone of the floor to firmly contact the foundation or footing. If only the sand or cement mix of the concrete mixture fills in the convolutions of the barrier and the stone does not, then there will not be enough strength to resist the inward pressure of the walls of the foundation. Thus, the sand and cement will crumble and allow the foundation to shift. However, when the stone fits firmly against the contact portion, the full strength of the concrete is retained.

Figure 11:
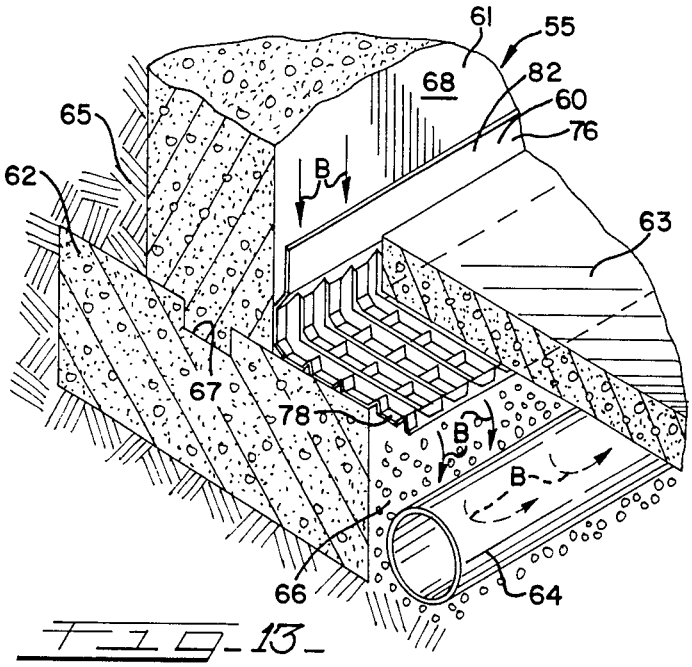
FIG. 11 is a sectional perspective view of still another product constructed in accordance with the instant invention installed in a structure.

Turning now to FIG. 11 there is shown a sectional perspective view of a structure 55 which embodies a product 60 constructed in accordance with the instant invention. Structure 55 includes a foundation 61, a footing 62, a floor 63 and a drain 64. Structure 55 is enclosed by earth 65 and fill 66.

In construction of structure 55, earth 65 was first excavated and footing 62 was installed by conventional means; for example, poured concrete. Footing 62 includes a notch 67 which is useful for aligning foundation 61 and supporting it from side forces. After footing 62 has been installed, foundation 61 is installed by conventional means; for example it may be poured concrete. Foundation 61 has a vertical wall 68 on its interior surface. Drain 64 is then installed and may be conventionally made from drain tile made of clay, plastic or other material. The drain tile may be pourous or have openings which allow water to enter it. Drain 64 will provide a conduit for water or other fluid and will convey it to a lower point of an exterior drainage area, or a sewer, or to a sump which may pump the water to the exterior drainage area outlet or sewers. Drain 64 is a conduit below floor level which will provide an outlet for any water which is present. After drain 64 is installed, fill 66 is installed to cover the drain and to avoid using large amounts of concrete when a concrete floor is poured. Fill 66 allows easy passage of water through it to drain 64. The construction steps so far are conventional and have been used for many years.

According to the instant invention, a user now inserts product 60 against foundatin 61 and footing 62. After product 60 has been inserted around substantially the entire exterior foundation and exterior footing of the structure, then floor 63 of poured concrete is installed. The pouring of concrete is done conventionally. Thus, in construction utilizing a product constructed in accordance with the instant invention, product 60 is placed alongside the exterior foundation and exterior footing prior to pouring of the concrete floor.

Figure 13:
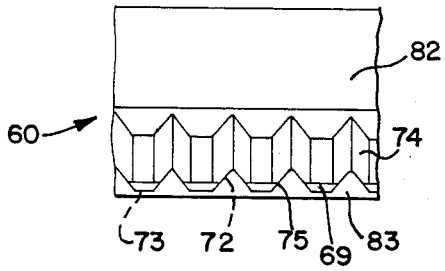
FIG. 13 is a front end view of the product of FIG. 11.
Figure 12:
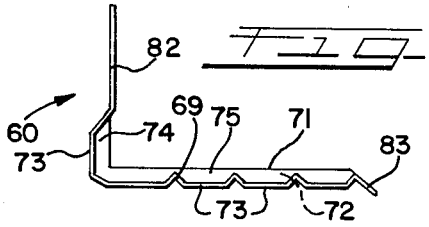
FIG. 12 is a side sectional view of the product of FIG. 11 taken along line 12—12 of FIG. 14.
Figure 14:
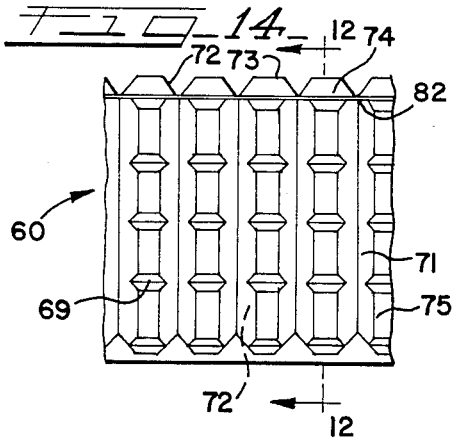
FIG. 14 is a plan view of the product of FIG. 11.

As is shown in FIGS. 12, 13 and 14, product 60 includes a barrier 71 which has a predetermined cross-sectional shape which forms conduit portions 72 and contact portions 73. Barrier 71 has an upper diverter portion 74 which is suitable for placement against the foundation and a lower diverter portion 75 which is suitable for placement against the footing. As best seen in FIG. 11 and FIG. 12, said upper diverter 74 is connected to said lower diverter 75 at approximately right angles to one another. Upper diverter 74 may extend above the surface of floor 63 as shown in FIG. 11 at point 76 or it may be trimmed even or below the floor surface. Lower diverter 75 must extend away from foundation 61 farther than footing 62 extends from foundation 61. Thus, portion 78 of lower diverter 75 extends away from foundation 61 farther than footing 62. As seen in FIGS. 12 and 13, barrier 71 has a cross-sectional shape which provides conduit portions 72 and contact portions 73. After installation, the upper diverter conduit portions and lower diverter conduit portions will allow water to flow from wall 68 through upper diverter conduit portions, through lower diverter conduit portions, through fill 66 to drain 64 as shown by arrows B. Longitudinal conduits 69 in lower diverter 75 allow water to travel not only horizontally toward the interior of the foundation, but also along the length of product 60. This allows for a safety factor if for some reason some of the horizontal conduits of lower diverter 75 become clogged by debris. Equally as important, said contact portions 73 will allow substantial structural contact between floor 63 and foundation 61 through upper diverter contact portions and substantial structural contact between floor 63 and footing 62 through lower diverter contact portions. Without substantial structural contact between the floor and the foundation wall, the walls could be forced in by earth 65.

Product 60 may be made from a plastic strong enough so as to keep its rigidity during the time after floor 63 is poured until it sets. The plastic material should resist or have a resistance to the water or the concrete for a period of time which will allow the concrete to set. The plastic material should also be strong enough to provide insignificant deformation should an installer walk on barrier 71. Alignment portion 82 allows a user to level the floor by using a string and chalk or other conventional means to mark the desired level on alignment strip 82 so that the concrete can be poured to the desired level. The floor may be poured to a level that is either above or below upper diverter 73 as long as the concrete does not flow over alignment strip 82. Installation lip 83 is provided so that during installation, concrete from floor 63 will not block the lower diverter conduit portions.

Product 60 made out of plastic will usually not biodegrade, however, if it did once the concrete has set, the significant structural contact has been provided so that the actual presence of product 60 is unnecessary. It is of critial importance that contact portions of the barrier significantly support the floor and the wall, because without significant support the walls, floors, foundation or footing may move, slide or be displaced. A displacement of a fraction of an inch could cause severe cracking of the walls, floor, foundation or footing. The user of the structure must take care to avoid filling the conduit portions of the barrier with debris. This will not be a problem if the interior foundation wall 68 is finished off allowing enough space to keep the upper conduit openings of upper diverter 74 unblocked.

Figure 15:
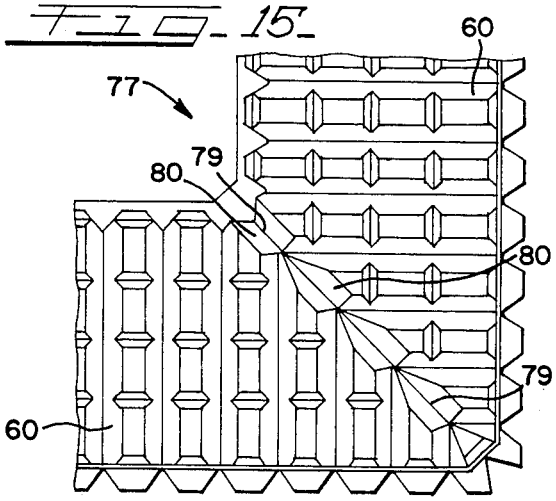
FIG. 15 is a plan view of a cornerpiece suitable for use with the product of FIG. 11 and constructed in accordance with the principles of the instant invention.

In FIG. 15, there is shown a cornerpiece 77. Cornerpiece 77 is constructed similarily to two pieces of product 60, mitered at 45°, and placed at a 90° angle to one another. At the connection 79 between the two pieces of product 60, an appropriate conduit portion 80 is formed so as to allow the conduit portions of each piece of product 60 to communicate with each other. In installation using a cornerpiece 77, the cornerpiece is first placed in the corners and then pieces of product 60 are laid extending out from the corners. Product 60 is designed to allow both the upper diverter 74 and the lower diverter 75 and their associated conduit portions and contact portions to stack or telescope when aligned parallel to one another.

Figure 16:
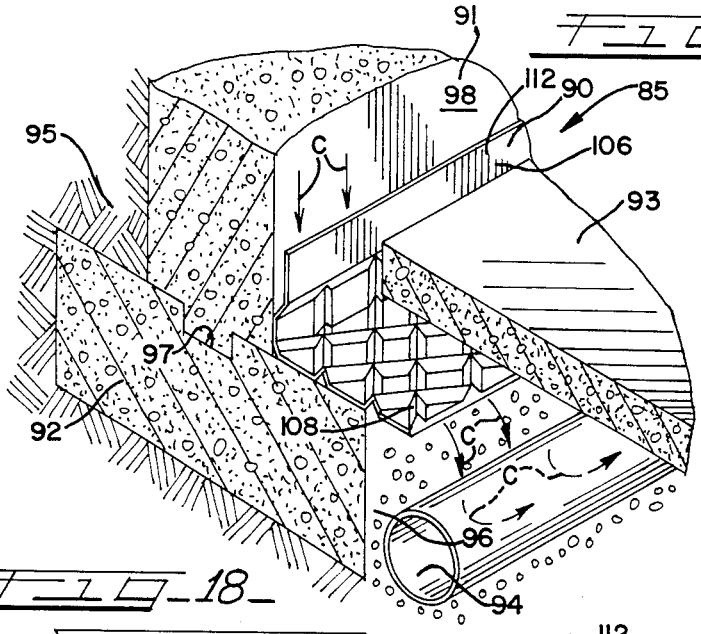
FIG. 16 is a sectional perspective view of still another product constructed in accordance with the principles of the instant invention installed in a structure.

Turning now to FIG. 16 there is shown a sectional perspective view of a structure 85 which embodies a product 90 constructed in accordance with the instant invention. Structure 85 includes a foundation 91, a footing 92, a floor 93 and a drain 94. Structure 85 is enclosed by earth 95 and fill 96.

In construction of structure 85, earth 95 was first excavated and footing 92 was installed by conventional means; for example, poured concrete. Footing 92 includes a notch 97 which is useful for aligning foundation 91 and supporting it from side forces. After footing 92 has been installed, foundation 91 is installed by conventional means; for example it may be poured concrete. Foundation 91 has a vertical wall 98 on its interior surface. Drain 94 is then installed and may be conventionally made from drain tile made of clay, plastic or other material. The drain tile may be porous or have openings which allow water to enter it. Drain 94 will provide a conduit for water or other fluid and will convey it to a lower point of an exterior drainage area, or a sewer, or to a sump which may pump the water to the exterior drainage area outlet or sewers. Drain 94 is a conduit below floor level which will provide an outlet for any water which is present. After drain 94 is installed, fill 96 is installed to cover the drain and to avoid using large amounts of concrete when a concrete floor is poured. Fill 96 allows easy passage of water through it to drain 94. The construction steps so far are conventional and have been used for many years.

According to the instant invention, a user now inserts product 90 against foundation 91 and footing 92. After product 90 has been inserted around substantially the entire exterior foundation and exterior footing of the structure, then floor 93 of poured concrete is installed. The pouring of concrete is done conventionally. Thus, in construction utilizing a product constructed in accordance with the instant invention, product 90 is placed alongside the exterior foundation and exterior footing prior to pouring of the concrete floor.

Figure 18:
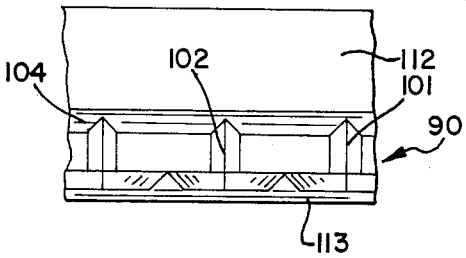
FIG. 18 is a front end view of the product of FIG. 16.
Figure 17:
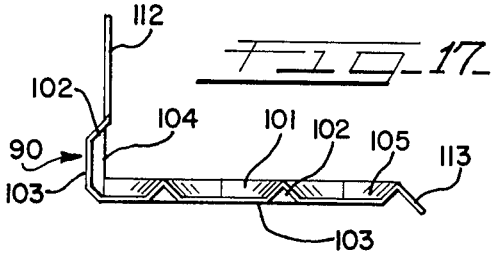
FIG. 17 is a side sectional view of the product of FIG. 16 taken along line 17—17 in FIG. 19.
Figure 19:
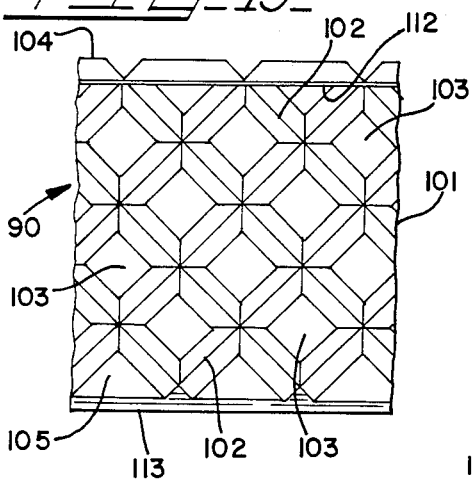
FIG. 19 is a plan view of the product of FIG. 16.

As is shown in FIGS. 17, 18 and 19, product 90 includes a barrier 101 which has a predetermined cross-sectional shape which forms conduit portions 102 and contact portions 103. Barrier 101 has an upper diverter portion 104 which is suitable for placement against the foundation and a lower diverter portion 105 which is suitable for placement against the footing. As best seen in FIG. 16 and FIG. 17, said upper diverter 104 is connected to said lower diverter 105 at approximately right angles to one another. Upper diverter 104 may extend above the surface of floor 93 as shown in FIG. 16 at point 106 or it may be trimmed even or below the floor surface. Lower diverter 105 must extend away from foundation 91 farther than footing 92 extends from foundation 91. Thus, portion 108 of lower diverter 105 extends away from foundation 91 farther than footing 92. As seen in FIGS. 17 and 19, barrier 101 has a cross-sectional shape which provides conduit portions 102 and contact portions 103. After installation, the upper diverter conduit portions and lower diverter conduit portions will allow water to flow from wall 98 through upper diverter conduit portions, through lower diverter conduit portions, through fill 96 to drain 94 as shown by arrows C. By the criss-crossing of the conduit portions of lower diverter 105, water may escape to a drain either longitudinally or horizontally. Equally as important, said contact portions 103 will allow substantial structural contact between floor 93 and foundation 91 through upper diverter contact portions and substantial structural contact between floor 93 and footing 92 through lower diverter contact portions. Without substantial structural contact between the floor and the foundation wall, the walls could be forced in by earth 95.

Product 90 may be made from a plastic or other material strong enough so as to keep its rigidity during the time after floor 93 is poured until it sets. The plastic or other material should resist or have a resistance to the water or the concrete for a period of time which will allow the concrete to set. The plastic or other material should also be strong enough to provide insignificant deformation should an installer walk on barrier 101. Alignment strip 112 allows a user to level the floor by using a string and chalk or other conventional means to mark the desired level on alignment strip 112 so that the concrete can be poured to the desired level. The floor may be poured to a level that is either above or below upper diverter 104 as long as the concrete does not flow over alignment strip 112. Installation lip 113 is provided so that during installation, concrete from floor 93 will not block the lower diverter conduit portions.

Product 100 made of a plastic will usually not biodegrade, however, if it did once the concrete has set, the significant structural contact has been provided so that the actual presence of product 90 is unnecessary. It is of critial importance that contact portions of the barrier significantly support the floor and the wall, because without significant support the walls, floors, foundation or footing may move, slide or be displaced. A displacement of a fraction of an inch could cause severe cracking of the walls, floor, foundation or footing. The user of the structure must take care to avoid filling the conduit portions of the barrier with debris. This will not be a problem if the interior foundation wall 98 is finished off allowing enough space to keep the upper conduit openings of upper diverter 104 unblocked.

Figure 20:
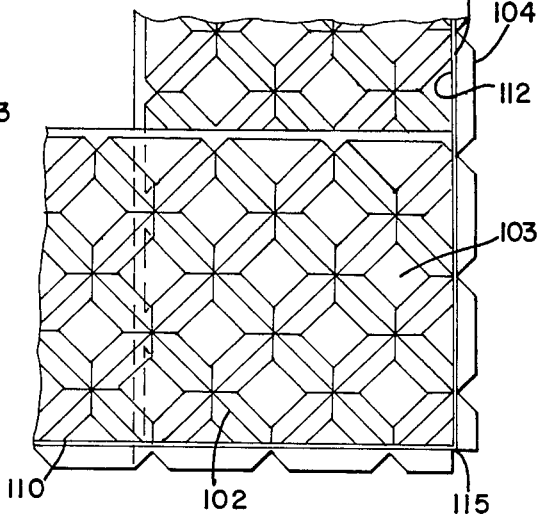
FIG. 20 is a plan view of an application of product of FIG. 16 in a corner of a structure.

FIG. 20 shows the advantages of using product 90 in corners. A special feature of product 90 is that the conduit portions of lower diverter 105 of barrier 101 are disposed at a 45° angle to the axis of intersection of upper diverter 104 and lower diverter 105. Also the conduit portions of lower diverter 105 are formed symmetrically so that when one piece of product 90 is turned 90° to another piece of product 90, the conduit portions of lower diverter 105 will stack or telescope into one another. Similarily, the contact portions of lower diverter 105 are arranged symmetrically so that when one piece of product 90 is turned 9020 to another piece of product 90, the contact portions of lower diverter 105 will stack or telescope into one another. The advantage of this telescoping feature is shown in FIG. 20 wherein piece 110 and piece 111 which are both constructed identical to product 90 are shown applied in a corner 115. In this arrangement piece 110 and piece 111 are at 90° angle to one another and a user would abutt piece 111 against one foundation wall at a corner, then abutt piece 110 against the other foundation wall at the corner. By this design of product 90 a special cornerpiece, mitering or cutting of product 90 is unnecessary to allow upper diverter 104 to completely align against the walls and fully into a corner.

In installing product 90 in a structure, the pieces of product 90 are placed in all the corners as described in the preceding paragraph. Then product 90 is laid extending out from the corners. Product 90 is designed to allow both the upper diverter 104 and the lower diverter 105 and their associated conduit portions and contact portions to stack or telescope when aligned parallel to one another. Thus, if for example, product 90 is made in four foot lengths and when the installer gets to the next corner, there is only a three foot opening, all the installer has to do is overlap product 90 onto the adjacent pieces of product 90. Thus, the need to cut the length of the final piece of product 90 is unnecessary. If desired, an installer can overlap a small portion of each piece of product 90 as he lays them against the footing and foundation. When this method of installation is done, the individual pieces of product 90 are locked together so as to resist movement during pouring of the floor or other construction impacts. This also avoids the possibility of openings or seams between the individual pieces of product 90 that might occur if the pieces were laid end to end and moved slightly during pouring of the floor.

This preferred product can be accomplished by having its upper diverter telescoping along its length or longitudinally and its lower diverter telescoping along both its length or longitudinally and its width or horizontally. By "length", it is meant the distance of the product parallel to the axis of intersection of the upper diverter portion and the lower diverter portion. By "width", it is meant the distance of the product from the axis of intersection of the upper diverter portion and the lower diverter portion to the installation lip.

Thus, it is apparent that there has been provided, in accordance with the instant invention, a structural water control that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A product useful for preventing water seepage onto a floor in a structure having a foundation, a footing, a floor and a drain below the floor, including:

a barrier having a cross-sectional shape which forms conduit portions and contact portions;

said barrier being suitable for placement against said foundation and said footing prior to installation of said floor;

said barrier having an upper diverter suitable for placement against said foundation;

said barrier having a lower diverter suitable for placement against said footing;

said upper diverter being connected to said lower diverter at approximately right angles to one another;

said lower diverter extending a distance away from said foundation farther than said footing extends from said foundation;

said cross-sectional shape providing conduit portions which allow water to travel through said upper diverter conduit portions to and through said lower diverter conduit portions, said lower diverter conduit portions having both horizontal and longitudinal conduits which allow water to travel either horizontally or longitudinally to a point under said floor and away from said footing to said drain under said floor; and said cross-sectional shape providing contact portions which allow substantial structural contact between said floor and said foundation, and said floor and said footing.

2. A product as in claim 1 wherein said upper diverter extends above said floor.

3. A product as in claim 1 wherein said cross-sectional shape of said barrier is a series of chevrons having said contact portions of said barrier flattened.

4. A product as in claim 3 wherein said flattened contact portions abutt against said foundation and said footing and said flattened contact portion has a length in the range of about one-quarter inch to one inch.

5. A product as in claim 4 wherein said conduit portions of said barrier extend away from said flattened contact portions by a distance of about one-quarter inch to one and one-half inches.

6. A product as in claim 1 wherein said cross-sectional shape of said barrier is a serpentine curve having said contact portions of said barrier wider than said conduit portions of said barrier wherein said contact portions are flattened.

7. A product as in claim 6 wherein said contact portions of said barrier are smooth curves having a radius of approximately between one inch and three inches and said conduit portions of said barrier extend away from the point of contact of said contact portion of said barrier with said foundation or said footing by a distance of approximately one-quarter inch to three-quarters inch.

8. A product as in claim 1 wherein said cross-sectional shape of said barrier is corrugated.

9. A product as in claim 1 wherein said cross-sectional shape of said barrier provides conduit portions having an arc which is substantially circular and having a radius of about three-quarters of an inch to one inch.

10. A product as in claim 9 wherein said contact portions are connected by a smooth curve forming said conduit portions and said conduit portions of said barrier extend away from the point of contact of said contact portion of said barrier with said foundation or said footing by a distance of approximately one-quarter inch to one-half inch.

11. A product as in claim 1 wherein an alignment strip is affixed to said upper diverter along its upper end so as to allow the upper surface of said floor to contact said alignment strip.

12. A product as in claim 11 wherein said upper diverter, said lower diverter and said alignment strip are all formed in a single unit.

13. A product as in claim 11 wherein said upper diverter, said lower diverter and said alignment strip are formed in separate units which are affixable to one another for installation.

14. A product as in claim 11 wherein two of said upper diverter, said lower diverter and said alignment strip are formed in a single unit and the third is affixed to the single unit.

15. A product as in claim 11 wherein said alignment strip is formed so as to close the top openings of said conduit portions of said upper diverter.

16. A product as in claim 11 wherein said barrier is made of one sided corrugated board having a connecting strip along the unfaced portion of said corrugated board opposite said right angle connection of said upper diverter and said lower diverter.

17. A product as in claim 16 wherein openings at the bottom of said upper diverter and openings at the top of said lower diverter are sealed with a material which will degrade in the presence of water no sooner than twenty-four hours after contact with said water, but will dissolve in the presence of water within two weeks after contact with water.

18. A product as in claim 16 wherein said barrier is resistant to water and will maintain its shape for a period of at least twenty-four hours after contact with water.

19. A product as in claim 18 wherein said barrier is resistant to concrete mix and will, maintain its shape for a period of at least twenty-four hours after contact with concrete mix.

20. A structure having:

an exterior foundation;

an exterior footing for said exterior foundation;

a floor;

a drain below said floor;

a barrier interposed between substantially all of said floor and said exterior foundation, and interposed between substantially all of said floor and said exterior footing;

said barrier having a cross-sectional shape forming conduit portions and contact portions in said barrier;

said conduit portions of said barrier allowing water to travel from said foundation between said foundation and said floor, along said footing both horizontally and longitudinally between said floor and said footing, to said drain below said floor; and said contact portions of said barrier allowing substantial structural contact between said floor and said foundation, and said footing and said floor.

21. A product useful for preventing water seepage onto a floor in a structure having a foundation, a footing, a floor and a drain below the floor, including:

a barrier having a cross-sectional shape which forms conduit portions and contact portions;

said barrier being suitable for placement against said foundation and said footing prior to installation of said floor;

said barrier having an upper diverter suitable for placement against said foundation;

said barrier having a lower diverter suitable for placement against said footing;

said upper diverter being connected to said lower diverter at approximately right angles to one another and defining a longitudinal axis;

said conduit portions allowing water to travel through said upper diverter conduit portions to and through said lower diverter conduit portions to a point under said floor;

said contact portions which allow substantial structural contact between said floor and said foundation, and said floor and said footing;

said upper diverter and said lower diverter formed so that when said product is stacked upon one another the corresponding conduit portions and contact portions will telescope into one another and wherein said lower diverter is formed so that when said product is stacked upon one another at a 90 degree angle, the corresponding conduit portions and contact portions will telescope into one another.

22. A product as in claim 21 wherein said lower diverter is formed so that when said product is stacked upon one another at a 90° angle, the corresponding conduit portions and contact portions will telescope into one another.

23. A product useful for preventing water seepage onto a floor in a structure having a foundation, a footing, a floor and a drain below the floor, including:

a barrier having a cross-sectional shape which forms conduit portions and contact portions;

said barrier being suitable for placement against said foundation and said footing prior to installation of said floor;

said barrier having an upper diverter suitable for placement against said foundation;

said barrier having a lower diverter suitable for placement against said footing;

said upper diverter being connected to said lower diverter at approximately right angles to one another and defining a longitudinal axis;

said conduit portions allowing water to travel through said upper diverter conduit portions to and through said lower diverter conduit portions to a point under said floor;

said contact portions allowing substantial structural contact between said floor and said foundation, and said floor and said footing;

said upper diverter being telescopically stackable longitudinally; and, said lower diverter being telescopically stackable both horizontally and longitudinally.

24. A product as in claim 22 wherein said lower diverter is telescopically stackable horizontally.

* * * * *